US008707529B2

(12) United States Patent
Voges

(10) Patent No.: US 8,707,529 B2
(45) Date of Patent: Apr. 29, 2014

(54) METHOD AND APPARATUS FOR BREAKING SCALE FROM SHEET METAL WITH RECOILER TENSION AND ROLLERS ADAPTED TO GENERATE SCALE BREAKING WRAP ANGLES

(75) Inventor: Kevin C. Voges, Shiloh, IL (US)

(73) Assignee: The Material Works, Ltd., Red Bud, IL (US)

( * ) Notice: Subject to any disclaimer, the term of this patent is extended or adjusted under 35 U.S.C. 154(b) by 1180 days.

(21) Appl. No.: 12/332,803

(22) Filed: Dec. 11, 2008

(65) Prior Publication Data

US 2010/0146757 A1 Jun. 17, 2010

(51) Int. Cl.
*C21D 8/02* (2006.01)

(52) U.S. Cl.
USPC ..... 29/81.01; 29/81.03

(58) Field of Classification Search
USPC ..... 29/81.01, 81.03, 81.05, 81.13, 421.1
See application file for complete search history.

(56) References Cited

U.S. PATENT DOCUMENTS

| | | | | |
|---|---|---|---|---|
| 2,913,809 | A | 11/1959 | Bongiovanni | |
| 2,937,431 | A | 5/1960 | Bongiovanni | |
| 3,184,825 | A | 5/1965 | Jones | |
| 3,389,591 | A | 6/1968 | Moline | |
| 3,394,574 | A | 7/1968 | Franek et al. | |
| 3,605,470 | A | 9/1971 | Polakowski | |
| 3,699,726 | A * | 10/1972 | Turner et al. | 451/38 |
| 3,839,888 | A * | 10/1974 | Greenberger | 72/11.7 |
| 3,841,132 | A | 10/1974 | Kuhn et al. | |
| 5,279,141 | A * | 1/1994 | Kenmochi et al. | 72/39 |
| 5,709,759 | A * | 1/1998 | Ljungars et al. | 148/645 |
| 5,879,465 | A | 3/1999 | McKevitt et al. | |
| 5,953,946 | A | 9/1999 | Mucke et al. | |
| 5,987,948 | A | 11/1999 | Neushutz et al. | |
| 6,840,475 | B1 | 1/2005 | Mucke et al. | |
| 6,874,724 | B2 | 4/2005 | Muller et al. | |
| 7,077,724 | B1 | 7/2006 | Voges | |
| 7,081,167 | B2 | 7/2006 | Voges | |
| 7,081,168 | B2 | 7/2006 | Voges | |
| 7,081,169 | B2 | 7/2006 | Voges | |
| 7,156,926 | B2 | 1/2007 | Voges | |
| 7,601,226 | B2 | 10/2009 | Voges et al. | |
| 2009/0002686 | A1 | 1/2009 | Voges et al. | |
| 2009/0227184 | A1 | 9/2009 | Voges et al. | |

FOREIGN PATENT DOCUMENTS

| | | |
|---|---|---|
| EP | 1072334 | 5/2002 |
| EP | 1171249 | 6/2005 |
| EP | 1563919 | 5/2006 |

(Continued)

*Primary Examiner* — David Bryant
*Assistant Examiner* — Christopher Besler
(74) *Attorney, Agent, or Firm* — Thompson Coburn LLP

(57) ABSTRACT

A metal processing apparatus comprises a scale breaker apparatus having a plurality of rollers positioned in a staggered arrangement and engaging first and second surfaces of sheet metal. The staggered arrangement creates clearances between the rollers of the first and second surface rollers sufficient to enable the sheet metal to conform to a portion of an outer periphery of at least one of the rollers while passing between the first and second surface rollers under a tensile force. The metal processing apparatus further comprises a recoiler adapted to coil the length of sheet metal. The recoiler subjects the sheet metal passing through the scale breaking apparatus to a tensile force sufficient to conform the sheet metal to a portion of the outer periphery of at least one of the rollers with a wrap angle sufficient to break scale from the sheet metal.

9 Claims, 3 Drawing Sheets

(56) References Cited

FOREIGN PATENT DOCUMENTS

| | | |
|---|---|---|
| FR | 1134278 | 10/1955 |
| GB | 1002936 | 9/1965 |
| RU | 454981 | 1/1975 |
| WO | 2006027172 | 3/2006 |

* cited by examiner

METHOD AND APPARATUS FOR BREAKING SCALE FROM SHEET METAL WITH RECOILER TENSION AND ROLLERS ADAPTED TO GENERATE SCALE BREAKING WRAP ANGLES

BACKGROUND

The disclosure pertains to a process for removing undesirable surface material from flat materials either in sheet or continuous form. In particular, the disclosure pertains to a method and apparatus for removing scale from the surfaces of processed sheet metal by subjecting the processed sheet metal to tension from a recoiler and passing the sheet metal through a plurality of rollers having a staggered arrangement generating a serpentine path of the sheet metal through the rollers and a wrap angle sufficient to break scale from the sheet metal.

DETAILED DESCRIPTION

Figure 1:
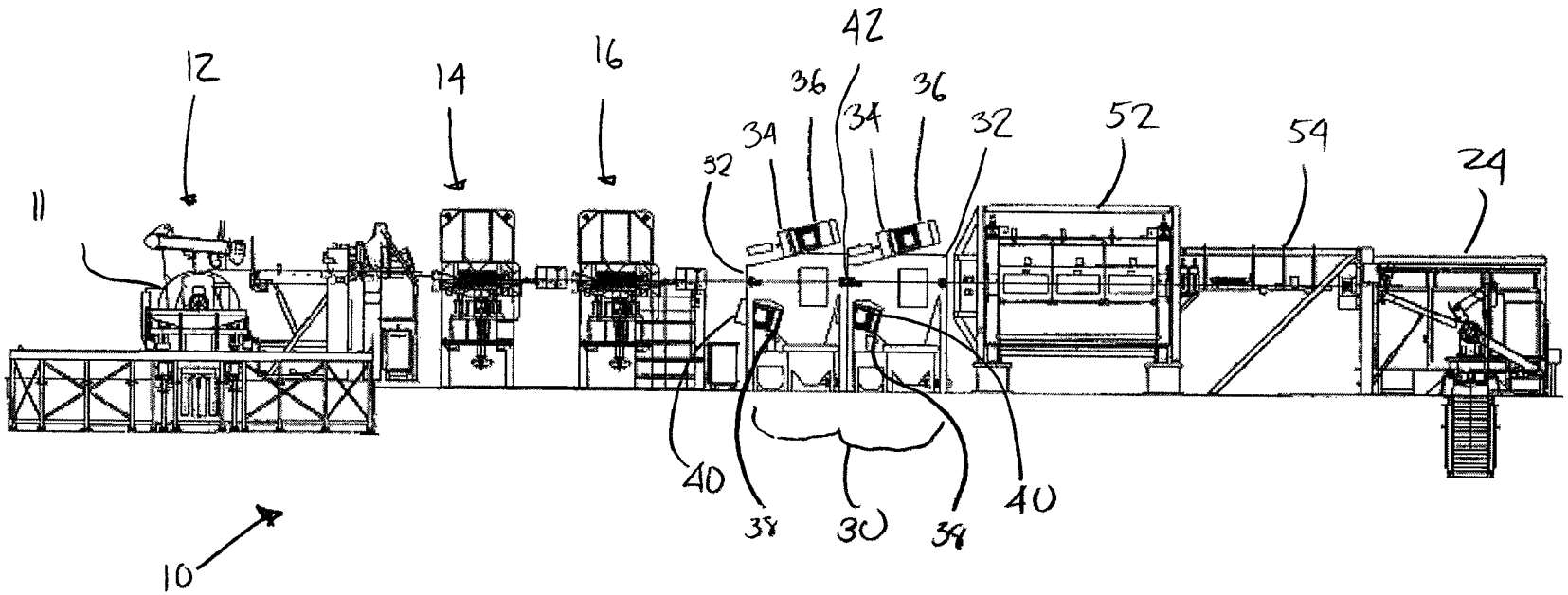
FIG. 1 is a schematic representation of a side elevation view of the processed sheet metal descaling apparatus and its method of operation.

FIG. 1 shows a schematic representation of the sheet metal processing apparatus 10. As will be explained, the sheet metal moves through the processing apparatus in a generally horizontal direction from left to right through the apparatus shown in FIG. 1. However, the sheet metal may also be oriented vertically, or at any other orientation as it passes through the various components of the apparatus shown in FIG. 1. Therefore, terms such as "top" and "bottom," "above" and "below," and "upper" and "lower," as used throughout the description, should not be interpreted as limiting the orientation of any of the apparatuses described herein or the orientation of the length of sheet metal for proper operation of the apparatus. Further, the component parts of the apparatus to be described and shown in FIG. 1 are one embodiment. It should be understood that variations and modifications could be made to the described embodiment, for instance, by removing or incorporating additional or redundant cells, without departing from the intended scope of protection provided by the claims of the application.

Figure 2:
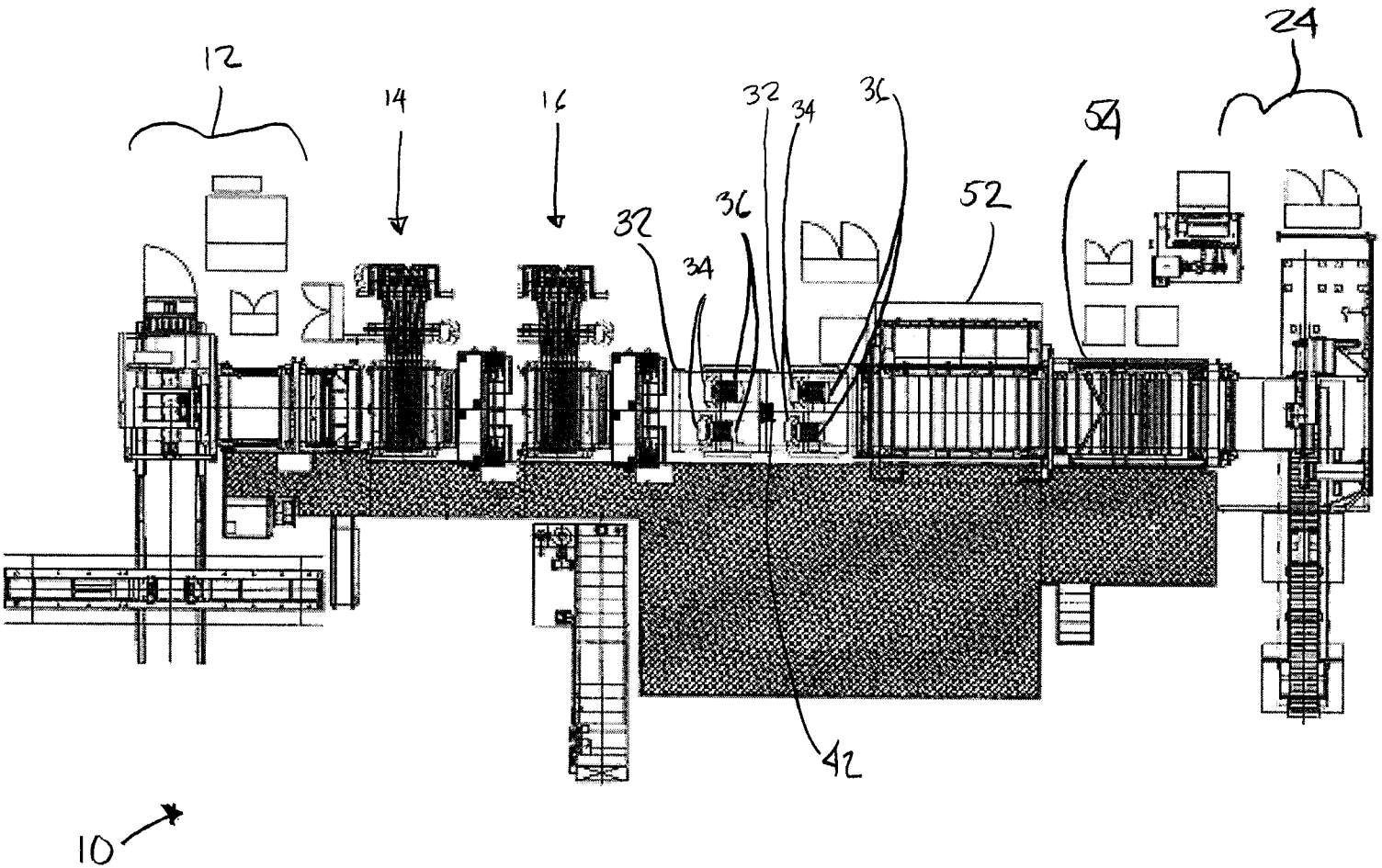
FIG. 2 is a schematic representation of a plan view of the apparatus of FIG. 1.
Figure 3:
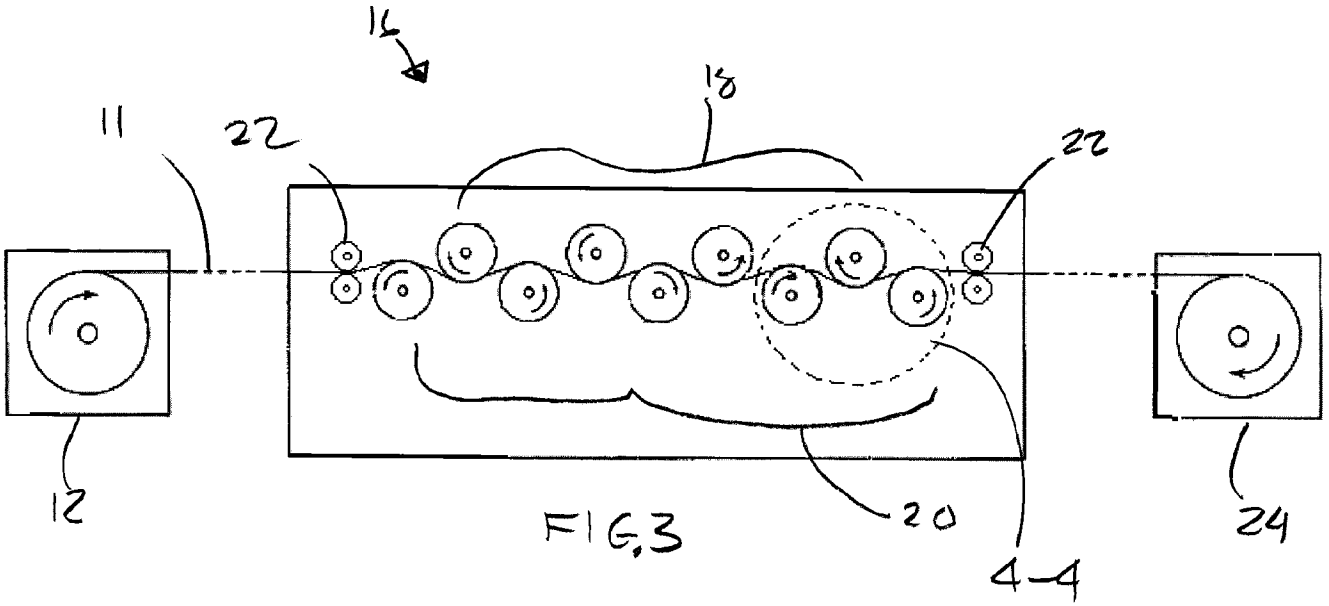
FIG. 3 is a representation of a side view of a descaler of the apparatus of FIG. 1.

Referring to FIGS. 1, 2, and 3, a coil 11 of previously processed sheet metal (for example hot rolled sheet metal) is positioned on an uncoiler 12 adjacent the sheet metal processing apparatus 10 for supplying a length of sheet metal to the sheet metal processing apparatus. The uncoiler 12 comprises a device that supports the sheet metal and functions to selectively uncoil the length of sheet metal from the roll in a controlled manner. Alternatively, the uncoiler may be omitted and the sheet metal may be supplied to the sheet metal processing apparatus as individual sheets. As shown in the drawings, a leveler 14 receives the sheet metal from the uncoiler and prepares the sheet metal for further processing in the sheet metal processing apparatus. The leveler may be a roller leveler with a plurality of spaced apart rollers that engages the top and bottom surfaces of the sheet metal. Although a roller leveler is shown in the drawing figures, other types of levelers may be employed in the apparatus and used in the processes herein described.

From the leveler, the length of processed sheet metal passes into a descaler cell 16. The combination of the roller leveler with the descaler cell contributes to the overall flatness of the sheet metal and line processing speed. The descaler cell 16 receives the processed sheet metal from the leveler 14 and conditions the sheet metal for subsequent processing in the line as will be described in greater detail below.

As best shown in the schematic drawing of FIG. 3, the descaler cell 16 comprises a first (or top in FIG. 3) set 18 of rollers engaging a top side of the sheet metal and a second (or bottom in FIG. 3) set of rollers 20 engaging a bottom side of the sheet metal. A pair of pinch rollers 22 may also be provided at the entrance and exit of the descaler cell to guide the sheet metal into and out of the descaler cell. In FIG. 3, the sheet metal is shown being uncoiled from the uncoiler 12 in the front of the line and being coiled by a recoiler 24 at the end of the line. Other components of the line shown in FIG. 1 have been omitted from FIG. 3 to simplify the drawings.

The top and bottom sets 18,20 of rollers of the descaler cell are arranged in a staggered fashion with the rollers comprising the top set of rollers and the rollers comprising the bottom set of rollers being spaced from each other longitudinally across the descaler cell. In the staggered arrangement, the rollers comprising the top set of rollers 18 are offset from the rollers comprising the bottom set of rollers 20 so as to allow the top and bottom sets of rollers to be partially nested in the respective spaces to define a serpentine path of the sheet metal passing through the descaler cell. The top set of rollers and bottom set of rollers may be arranged in a spaced-apart arrangement by providing greater longitudinal distance between centers, thereby creating clearance between the rollers allowing the top set of rollers to be "plunged between" the bottom set of rollers. The nested or "plunged between" arrangement creates clearance between the rollers that allows the sheet metal passing through the rollers to conform to a portion of an outer periphery of at least one of the rollers with a wrap angle 26 sufficient to break scale while the sheet metal is passing through the descaler cell.

Figure 4:
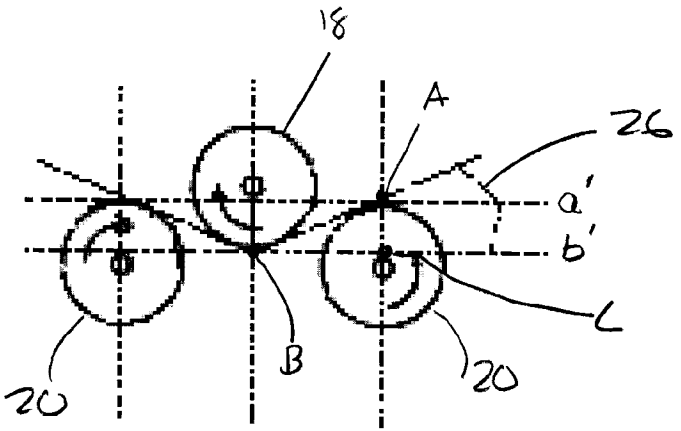
FIG. 4 is an enlarged view of detail area 4-4 of FIG. 3.

FIG. 4 shows greater detail of the spacing of the top surface roller 18 and the bottom surface rollers 20, and the wrap angle 26 created therebetween. The positioning of the rollers has been exaggerated for illustrative purposes of showing the wrap angle 26, which in FIG. 4 is formed between points A,B, and C, where (a) point A comprises the point at which a horizontal reference line a' intersects with a vertical reference line extending through a center of the right bottom roller at an outer surface of the right bottom roller, (b) point B comprises the point at which a horizontal reference line b' intersects with a vertical reference line extending through a center of the top center roller at an outer surface of the top center roller, and (c) point C comprises the point at which the vertical line extending through the center of the bottom right roller intersects with horizontal reference line b'. Other nesting arrangements may produce other wrap angles.

As shown in FIG. 3, the rollers comprising the top set of rollers 18 and the rollers comprising the bottom set of rollers 20 have the same diameter and rotate about their respective center axes at a substantially uniform distance from the sheet metal. In order to create the serpentine path, the vertical distance between the rollers' center axes and the sheet metal is less than the respective radii of the rollers of the first and second sets of rollers. The wrap angle 26 is thus in part a function of the vertical distance, the diameter of the rollers, the longitudinal spacing, the tension applied to the sheet, and the thickness of the sheet. It should be appreciated that any size diameter of roller and spacing may be used, provided the sheet metal conforms to at least one roller with a wrap angle sufficient to break scale. Accordingly, it is not necessary that each of the rollers have the same diameter or be positioned from the sheet metal at the same distance. Other configurations and positioning of the rollers may be used provided sufficient clearance is maintained between the rollers to generate wrap angles sufficient to break scale. Preferably, the rollers are arranged to sequentially engage against and bend one surface of the sheet metal across each sequential roller to break scale on the opposite surface of the sheet metal from the roller when the sheet metal is pulled in tension across the sequence of rollers by the recoiler.

Because of the clearance generated by spacing the rollers apart, a variety of different thicknesses of sheet metal may be processed with rollers positioned at a single set position, thus reducing the frequency and/or time of set-up required for the descaler cell. Thus, the rollers comprising the top and bottom sets of rollers may be set as a block for a range of sheet thicknesses, i.e., roller sets ganged together in a block. Different ganged blocks of rollers may then be set with different clearances for other sheet thickness ranges, and staged and interchanged in the descaler cell, as necessary depending upon the application, to reduce set-up time associated with the descaler cell(s). The rollers may also be selectively positionable relative to the framework comprising the descaling cell, for instance, with either the top and bottom sets being selectively positionable or each roller being individually positionable. In any case, the rollers are preferably set to generate clearance therebetween as necessary so as to enable the generation of wrap angles sufficient to break scale. Generally speaking, the wrap angle needed to break scale from lighter gage materials is greater than the wrap angle needed to break scale from heavier gage materials. For instance, the rollers may be set to generate a wrap angle of about 10 degrees for breaking scale from heavy gauge materials (0.375" thick), and other times, the rollers may be set to generate a wrap angle of at least 20 degrees as may be needed for breaking scale from 10 gauge or lighter gauge hot rolled steel sheets.

In order to provide sufficient tension to enable the sheet metal to conform to the rollers, the recoiler 24 provided at the end of the line subjects the sheet metal to a tensile force. The combination of the tensile force created by the recoiler 24 and the wrap angle 26 generated by the clearance of the staggered arrangement of the top and bottom sets of rollers 18,20 breaks scale from the sheet metal. In order to allow the sheet metal to conform to the rollers of the top and bottom sets of rollers, the recoiler may be operated to subject the sheet metal in the descaler to a tensile force from about 20,000 pounds to about 100,000 pounds. Preferably, the tensile force is sufficient to allow the sheet metal to conform to at least one roller of the rollers comprising the first and second sets of rollers.

After passing through the descaling apparatus, the sheet metal passes through a secondary descaling or surface finishing cell(s) 30. Preferably, the descaler cell 16 is placed in front of the secondary descaling or surface finishing cell(s) 30. Commonly assigned and co-pending application entitled Slurry Blasting Apparatus for Removing Scale from Sheet Metal and having Ser. Nos. 11/531,907 and 12/051,537 describes in further detail the methods and apparatus comprising the descaling or surface finishing cell(s) 30 shown in FIGS. 1 and 2, and the disclosures of co-pending application Ser. Nos. 11/531,907 and 12/051,537 are incorporated by reference herein.

The secondary descaling or surface finishing cells 30 are best shown in FIGS. 1 and 2 and consist of two matched pairs of centrifugal impeller systems, with one pair being installed to process the top side of the sheet metal and the other pair being installed to process the bottom side of the sheet metal. The number of the surface finishing cells is chosen to match the desired line speed of the apparatus, and ensuring adequate removal of scale and subsequent adjustment of surface texture.

Each surface finishing cell is basically comprised of a hollow box 32. A portion of the length of sheet metal is shown passing through the surface finishing boxes 32. The length of sheet metal is shown oriented in a generally horizontal orientation as it passes through the surface finishing box 32. An upstream end wall of the box has a narrow entrance opening slot to receive the width and thickness of the length of sheet metal from the descaler cell 16. An opposite downstream end wall of the box has a narrow slot exit opening that is also dimensioned to receive the width and thickness of the length of sheet metal. The openings are equipped with sealing devices engineered to contain the slurry within the box during the processing of the strip. A pair of driven centrifugal impellers 34 are installed in lined casings, shrouds or cowlings which are mounted to a top wall of the box 32. The shrouds have hollow interiors that communicate through openings in the box top wall with the interior of the box. As shown best in FIG. 2, the slurry impeller casing shrouds are not positioned side by side, but are positioned on the box top wall in a staggered arrangement. This is done to ensure that the slurry discharging from one impeller does not interfere with the slurry from the other impeller of the pair. A pair of electric motors 36 is mounted on the pair of shrouds. Each of the electric motors 36 has an output shaft that extends through a wall of its associated shroud and into the interior of the shroud and drives the impeller wheels.

The slurry is discharged from the impeller wheels at a low wheel velocity, preferably below 200 feet per second to produce a good commercially acceptable RA (i.e., roughness) and not embed scale or grit particles into the softer steel surface. As mentioned in the related application, the electric motors 36 can rotate the impeller wheels in the first cell shown to the left in FIG. 1 at a faster speed than the impeller wheels in the second cell shown to the right of FIG. 1. The slurry discharged from the first cell will impact the material with a greater force and remove substantially all of the scale from the surfaces of the material. The slurry discharged from the second cell will impact the material at a reduced force and will generate smoother surfaces on the opposite sides of the material. Furthermore, the grit employed in the slurry discharged from each of the cells 30 can be of different sizes. A larger grit in the slurry discharged from the first cell would impact the surfaces of the material to substantially remove all of the scale from the surfaces of the material. A smaller grit in the slurry discharged from the second cell will impact the surfaces of the material to generate smooth surfaces on the opposite sides of the material. A slurry of water and #20 conditioned cut wire shot can used in the first surface finishing cell, to optimize scale removal from hot rolled carbon steel strip. The resulting surface texture is adjusted by using a range of softer stainless steel shot in the second surface finishing cell. A blend of #30 and #10 shot has proven satisfactory. Corrosion inhibitors may be added to the liquid if the product is not to be oiled after processing. The specific products being selected are based on the subsequent use of the sheet being processed and the level of protection required.

A second pair of centrifugal slurry impellers 38 may be mounted to bottom wall panels of the surface finishing boxes 32 to condition the bottom surface of the sheet. The units will be identical in basic function and size to the top pair. Both the axes of first pair of impellers 34 and the axes of the second pair 38, and their assemblies are mounted to the surface finishing box 32 oriented at an angle relative to the direction of the length of sheet metal passing through the descaler box 32. The axes of a second pair of motors 40 are also oriented at an angle relative to the plane of the length of sheet metal passing through the descaler cell 30. This angle is selected to ensure a stable flow of slurry, to reduce interference between rebounding particles and those that have not yet impacted the strip surface, and to improve the scouring action of the abrasive, to improve effectiveness of material removal, and to reduce the forces that would tend to embed material into the strip that would have to be removed by subsequent impacts. In a variant embodiment of the apparatus, the pair of motors 36,40 can be simultaneously adjustably positioned about a pair of axes that are perpendicular to the axes of rotation of the respective impellors 34,38 to adjust the angle of impact of the scale removing medium with the surface of the sheet metal. For instance, the axes of rotation of the motors 36 shown in FIG. 1 are oriented at an angle of substantially 20 degrees relative to the surface of the strip moving through the apparatus. In a preferred embodiment, the positions of the motors 36 are adjustable to vary the angle of the slurry blast projected toward the surface of the strip from directly down at the strip surface (i.e., the axes of rotation of the motors 36 being parallel with the surface of the strip) to an approximate angle of 60 degrees between the axes of rotation of the motors 36 and the strip surface.

In the embodiment of the apparatus processing line shown in FIGS. 1 and 2, two blasting cells 30 are positioned sequentially in the path of the sheet metal 16 passing through the line of the apparatus. An oxide detector 42 may be positioned between the two surface finishing cells 30 shown in FIG. 1. The oxide detector 42 may be configured to detect the level of scale remaining on the strip surface after the surface passes through the first surface finishing cell, and can be used to operate the subsequent surface finishing cell to effectively remove any remaining scale on the surface of the sheet metal.

A brusher 52 may be positioned adjacent the surface finishing cell 30 to receive the length of sheet metal from the surface finishing cells. The brusher 52 could be of the type disclosed in the Voges U.S. Pat. No. 6,814,815, the disclosure of which is incorporated herein by reference. The brusher 52 comprises pluralities of rotating brushes arranged across the width of the sheet metal. The rotating brushes contained in the brusher 52 contact the opposite top and bottom surfaces of the length of sheet metal as the sheet metal passes through the brusher 52, and produce a unique brushed and blasted surface, generally with a lower surface roughness, with some directionality. The brushes act with water sprayed in the brusher 52 to process the opposite surfaces of the sheet metal, thereby adjusting or modifying the texture of the surfaces created by the blasting cells 30. Alternatively, the brusher 52 could be positioned upstream of the surface finishing cells 30 to receive the length of sheet metal prior to the surface finishing cells. In this positioning of the brusher 52, the brusher would reduce the workload on the surface finishing cells 30 in removing loosely adhered scale from the surfaces of the sheet metal not otherwise removed from the roll descalers. The brusher may also be eliminated or replace the surface finishing cells.

A dryer 54 may be positioned adjacent the brusher 52 to receive the length of sheet metal from the brusher, or directly from the slurry blaster if the brushing unit is not installed or is deselected. The dryer 54 dries the liquid from the surfaces of the length of sheet metal as the sheet metal passes through the dryer. The liquid is residue from the rinsing process.

As mentioned previously, the recoiler 24 receives the length of sheet metal from the dryer 54 and winds the length of sheet metal into a coil for storage or transportation of the sheet metal. Preferably, the recoiler is the sole source of front tension provided in sheet metal processing apparatus, so that the combination of the tensile force created by the recoiler and the wrap angle generated by the clearance of the staggered arrangement of the top and bottom sets of rollers breaks scale from the sheet metal. In that regard, the recoiler may be operated to subject the sheet metal in the descaler to a tensile force from about 20,000 pounds to about 100,000 pounds.

In alternative line configurations/embodiments, the length of sheet metal processed by the apparatus may be further processed by a coating being applied to the surfaces of the sheet metal, for example a galvanizing coating or a paint coating. Although the embodiment described herein incorporates slurry blasting equipment in a secondary descaling or surface finishing cell, other equipment may be used in lieu thereof or in varying combinations, for instance, dry shot blasting equipment, rotary brush equipment, or pickling tanks may be incorporated in the line after the descaling apparatus. The length of sheet metal could also be further processed by running the length of sheet metal through the line apparatus shown in FIGS. 1 and 2 a second time. It should also be appreciated that the opposite surfaces of the length of sheet metal could be processed by the apparatus differently, for example by employing different surface finishing medium supplied to the wheels above and below the length of sheet metal passed through the apparatus.

It will be understood that modifications and variations may be effective without departing from the scope of the novel concepts disclosed herein, but it is understood that this application is limited only by the scope of the appended claims.

What is claimed is:

1. A method comprising:

receiving into a scale breaking apparatus a continuous length of sheet metal having opposite first and second surfaces across the length of the sheet metal passing through the scale breaking apparatus;

positioning a first set of rollers of the scale breaking apparatus to engage against the first surface of the sheet metal;

positioning a second set of rollers of the scale breaking apparatus to engage against the second surface of the sheet metal;

positioning the first and second sets of rollers with clearance relative to each other to enable the length of the sheet metal passing through the scale breaking apparatus to conform to an outer surface of at least one of the first and second sets of rollers as the length of the sheet metal passes between the first and second sets of rollers under a tensile force; and operating a recoiler to subject the length of the sheet metal passing between the first and second sets of rollers of the scale breaking apparatus to the tensile force and to form a wrap angle in at least a portion of the length of the sheet metal sufficient to break scale from the length of the sheet metal while coiling the length of the sheet metal with the recoiler;

wherein the tensile force applied to the length of the sheet metal by the recoiler in the scale breaking apparatus is in a range from about 20,000 pounds to about 100,000 pounds.

2. The method of claim 1, wherein step of positioning the first and second sets of rollers relative to each other further comprises positioning the first and second sets of rollers in a staggered arrangement relative to each other.

3. The method of claim 1, wherein each of the rollers comprising the first set of rollers has a substantially uniform diameter dimension and each of the rollers comprising the second set of rollers has a substantially uniform diameter dimension.

4. The method of claim 3, wherein step of positioning the first and second sets of rollers relative to each other further comprises:

positioning the first set of rollers to rotate about their respective center axes at a first uniform distance from the length of the sheet metal, the first uniform distance being less than a dimension of radii of the rollers comprising the first set of rollers; and positioning the second set of rollers to rotate about their respective center axes at a second uniform distance from the sheet metal, the second uniform distance being less than a dimension of radii of the rollers comprising the second set of rollers.

5. The method of claim 3, wherein the step of positioning the first and second set of rollers relative to each other further comprises:

partially nesting the first set of rollers with the second set of rollers to define a serpentine path between the first and second sets of rollers.

6. The method of claim 1, wherein the wrap angle formed in the portion of the length of the sheet metal is at least about 20 degrees.

7. The method of claim 1, wherein the step of positioning the first and second sets of rollers relative to each other further comprises:

providing the plurality of the first rollers with their outer surfaces having substantially commonly aligned tangent points that define a plane across the plurality of the first rollers; and positioning the second rollers to intersect the plane defined by the plurality of the first rollers.

8. The method of claim 1, wherein the step of positioning the first and second sets of rollers relative to each other further comprises:

providing the plurality of the second rollers with their outer surfaces having substantially commonly aligned tangent points that define a plane across the plurality of the second rollers; and positioning the first rollers to intersect the plane defined by the plurality of the second rollers.

9. The method of claim 1 wherein the recoiler is the sole source of front tension provided by the scale breaking apparatus.

* * * * *